US008108216B2

(12) United States Patent
Morita et al.

(10) Patent No.: US 8,108,216 B2
(45) Date of Patent: Jan. 31, 2012

(54) SPEECH SYNTHESIS SYSTEM AND SPEECH SYNTHESIS METHOD

(75) Inventors: Masahiro Morita, Yokohama (JP); Takehiko Kagoshima, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 971 days.

(21) Appl. No.: 12/051,104

(22) Filed: Mar. 19, 2008

(65) Prior Publication Data

US 2009/0018836 A1 Jan. 15, 2009

(30) Foreign Application Priority Data

Mar. 29, 2007 (JP) ..... 2007-087857

(51) Int. Cl.
*G10L 13/06* (2006.01)
*G10L 13/00* (2006.01)

(52) U.S. Cl. ..... 704/267; 704/258; 704/260; 704/268

(58) Field of Classification Search ..... 704/258, 704/260, 267, 268
See application file for complete search history.

(56) References Cited

U.S. PATENT DOCUMENTS 7,640,161 B2 * 12/2009 Morris et al. ..... 704/258
7,761,299 B1 * 7/2010 Beutnagel et al. ..... 704/258
2003/0115049 A1 * 6/2003 Beutnagel et al. ..... 704/220
2004/0093213 A1 * 5/2004 Conkie ..... 704/258
2005/0027532 A1 * 2/2005 Okutani et al. ..... 704/260
2005/0182629 A1 * 8/2005 Coorman et al. ..... 704/266
2006/0085194 A1 * 4/2006 Okutani et al. ..... 704/258
2009/0076819 A1 * 3/2009 Wouters et al. ..... 704/260

FOREIGN PATENT DOCUMENTS

JP 2001-282278 10/2001
JP 2005-266010 9/2005

* cited by examiner

*Primary Examiner* — Douglas Godbold
(74) *Attorney, Agent, or Firm* — Turocy & Watson, LLP

(57) ABSTRACT

In a speech synthesis, a selecting unit selects one string from first speech unit strings corresponding to a first segment sequence obtained by dividing a phoneme string corresponding to target speech into segments. The selecting unit performs repeatedly generating, based on maximum W second speech unit strings corresponding to a second segment sequence as a partial sequence of the first sequence, third speech unit strings corresponding to a third segment sequence obtained by adding a segment to the second sequence, and selecting maximum W strings from the third strings based on a evaluation value of each of the third strings. The value is obtained by correcting a total cost of each of the third string candidate with a penalty coefficient for each of the third strings. The coefficient is based on a restriction concerning quickness of speech unit data acquisition, and depends on extent in which the restriction is approached.

24 Claims, 10 Drawing Sheets

46

| Unit number | Storage information | Phoneme of interest | Concatenation phonemes (two each before and after) | Fundamental frequency | Phoneme duration time | Cepstral coefficient | |
|---|---|---|---|---|---|---|---|
| | | | | | | Start | End |
| ⋮ | ⋮ | ⋮ | ⋮ | ⋮ | ⋮ | ⋮ | ⋮ |
| F10 | F | /a/ | /-//K/, /i//m/ | 221Hz | 83msec | 2.54, 0.24, ... | 2.49, 0.18, ... |
| S100 | S | /a/ | /a//m/, /k//e/ | 296Hz | 125msec | 2.33, 0.28, ... | 2.55, 0.22, ... |
| S101 | S | /i/ | /o//K/, /r//u/ | 240Hz | 61msec | 2.54, -0.35, ... | 2.23, 0.02, ... |
| ⋮ | ⋮ | ⋮ | ⋮ | ⋮ | ⋮ | ⋮ | ⋮ |

FIG. 6

| | Number of speech units in low-speed storage medium | Total cost | Penalty coefficient | Beam evaluation value | Speech unit string selected according to total cost | Speech unit string selected according to beam evaluation value |
|---|---|---|---|---|---|---|
| $p_{3,1}$ | 2 | 0.8 | 1.44 | 1.15 | ○ | ○ |
| $p_{3,2}$ | 2 | 1.0 | 1.44 | 1.44 | ○ | |
| $p_{3,3}$ | 2 | 1.1 | 1.44 | 1.58 | ○ | |
| $p_{3,4}$ | 1 | 1.2 | 1.0 | 1.20 | | ○ |
| $p_{3,5}$ | 2 | 1.3 | 1.44 | 1.87 | | |
| $p_{3,6}$ | 1 | 1.4 | 1.0 | 1.40 | | ○ |
| $p_{3,7}$ | 2 | 1.6 | 1.44 | 2.30 | | |

FIG. 13

SPEECH SYNTHESIS SYSTEM AND SPEECH SYNTHESIS METHOD

CROSS-REFERENCE TO RELATED APPLICATIONS

This application is based upon and claims the benefit of priority from prior Japanese Patent Application No. 2007-087857, filed Mar. 29, 2007, the entire contents of which are incorporated herein by reference.

BACKGROUND OF THE INVENTION

1. Field of the Invention

The present invention relates to a speech synthesis system and speech synthesis method which synthesize speech from a text.

2. Description of the Related Art

Text-to-speech synthesis is to artificially generate a speech signal from an arbitrary text. The text-to-speech synthesis is generally implemented by three stages, i.e., a language processing unit, a prosodic processing unit, and a speech synthesis unit.

First of all, the language processing unit performs morphological analysis and syntax analysis, and the like on an input text. The prosodic processing unit then performs accent and intonation processes and outputs phoneme string/prosodic information (information of prosodic features (a fundamental frequency, duration or phoneme duration time, power, and the like)). Finally, the speech synthesis unit synthesizes a speech signal from the phoneme string/prosodic information. Hence, a speech synthesis method used in the speech synthesis must be able to generate synthetic speech of an arbitrary phoneme symbol string with arbitrary prosodic features.

Conventionally, as such speech synthesis method, the following speech unit selection type speech synthesis method is known. First of all, this method divides an input phoneme string into a plurality of synthesis units (a synthesis unit string). Aiming at the input phoneme string/prosodic information, the method selects a speech unit from a large quantity of speech units stored in advance for each of the plurality of synthesis units. Speech is then synthesized by concatenating the selected speech units between synthesis units. For example, in the speech unit selection type speech synthesis method disclosed in JP-A 2001-282278 (KOKAI), the degree of deterioration in speech synthesis caused when speech is synthesized is expressed as a cost, and speech units are selected so as to reduce the cost calculated based on a predefined cost function. For example, this method quantifies deformation distortion and concatenation distortion, which are cased when speech units are edited and concatenated, by using a cost, and selects a speech unit string used for speech synthesis on the basis of the cost. The method then generates synthetic speech on the basis of the selected speech unit string.

In such a speech unit selection type speech synthesis method, in order to improve sound quality, it is very important to prepare various phonetic environments and as many variations of prosodic features by having more speech units. It is, however, difficult in terms of cost (or price) to entirely store a large amount of speech unit data in an expensive storage medium (e.g., a memory device) with high access speed. In contrast, if a large amount of speech unit data are entirely stored in a storage medium (e.g., a hard disk) with a relative low cost (or price) and low access speed, it takes too much time to acquire data. This makes it impossible to perform real-time processing.

The size of speech unit data is mostly occupied by waveform data. Under the circumstance, there is known a method of storing waveform data with a high frequency of use in a memory device, and other waveform data in a hard disk, and sequentially selecting speech units from the start on the basis of a plurality of sub-costs including a cost (access speed cost) associated with the speed of access to a storage device storing waveform data. For example, the method disclosed in JP-A 2005-266010 (KOKAI) can achieve relatively high sound quality because it allows the use of a large amount of speech units distributed in a memory and a hard disk. In addition, since this method preferentially selects speech units whose waveform data are stored in the memory with a high access speed, the method can shorten the time required to generate synthetic speech as compared with the method of acquiring all waveform data from the hard disk.

Although The method disclosed in JP-A 2005-266010 (KOKAI) can shorten the time required to generate synthetic speech on the average, it is possible that in a specific unit of processing, only speech units whose waveform data are stored in the hard disk may be selected. This makes it impossible to properly control the worst value of the generation time per unit of processing. A speech synthesis application which synthesizes speech and immediately uses the synthetic speech online generally repeats the operation of playing back the synthetic speech generated for a given unit of processing by using an audio device, and generating synthetic speech for the next unit of processing (and sending it to the audio device) during the playback. With this operation, synthetic speech is generated and played back online. In such an application, if the generation time of synthetic speech in a given unit of processing exceeds the time taken to play back synthetic speech for a preceding unit of processing, sound interruption occurs between units of processing. This may greatly degrade sound quality. It is therefore necessary to properly control the worst value of the time required to generate synthetic speech per unit of processing. In addition, according to the method disclosed in JP-A 2005-266010 (KOKAI), speech units whose waveform data are stored in the memory are selected more than necessary. This may result in failure to achieve optimal sound quality.

Under the restriction concerning the acquisition of speech unit data from storage media with different data acquisition speeds for a synthesis unit string (for example, the upper limit value of the number of times of acquisition of data from a hard disk per unit of processing), there is available a method of selecting an optimal speech unit string concerning the synthesis unit string. This method can reliably suppress the upper limit of the generation time of synthetic speech per unit of processing, and can generate synthetic speech with as high sound quality as possible within a predetermined generation time.

It is possible to search for an optimal speech unit string under the above restriction efficiently by the dynamic programming method in consideration of the restriction. If, however, there are many speech units, it still requires much calculation time. Therefore, a means for further speeding up the processing is required. A search under some restriction, in particular, requires more calculation amount than a search without any restriction, and hence it is necessary in particular to speed up the processing.

As a speeding up means, it is conceivable to perform a beam search with reference to a total cost as an evaluation reference for a speech unit string. In this case, in the process of sequentially developing speech unit strings for each synthesis unit by the dynamic programming method, W speech unit strings are selected in ascending order of total cost at the time point when the speech unit strings are developed up to a given synthesis unit, and only strings from the selected W speech unit strings are developed for the next synthesis unit.

The following problem arises when this method is applied to a beam search under the above restriction. In the first half of the process of sequentially developing speech unit strings, only speech unit strings including many speech units stored in a storage medium with a low access speed may be selected because of a low total cost. In this case, in the second half of the process, only speech units stored in a storage medium with a high access speed are allowed to be selected to satisfy the restriction. This problem arises especially when most of speech units are stored in a storage medium with a low access speed and the proportion of speech units stored in a storage medium with a high access speed is very low. As a consequence, sound quality unevenness occurs in generated synthetic speech, resulting in a deterioration in sound quality as a whole.

BRIEF SUMMARY OF THE INVENTION

According to an aspect of the present invention, there is provided a speech synthesis system includes a dividing unit configured to divide a phoneme string corresponding to target speech into a plurality of segments to generate a first segment sequence; a selecting unit configured to generate a plurality of first speech unit strings corresponding to the first segment sequence by combining a plurality of speech units based on the first segment sequence and select one speech unit string from said plurality of first speech unit strings; and a concatenation unit configured to concatenate a plurality of speech units included in the selected speech unit string to generate synthetic speech, the selecting unit including a searching unit configured to perform repeatedly a first processing and a second processing, the first processing generating, based on maximum W (W is a predetermined value) second speech unit strings corresponding to a second segment sequence as a partial sequence of the first segment sequence, a plurality of third speech unit strings corresponding to a third segment sequence as a partial sequence obtained by adding a segment to the second segment sequence, and the second processing selecting maximum W third speech unit strings from said plurality of third speech unit strings, a first calculation unit configured to calculate a total cost of each of said plurality of third speech unit strings, a second calculation unit configured to calculate a penalty coefficient corresponding to the total cost for each of said plurality of third speech unit strings based on a restriction concerning quickness of speech unit data acquisition, wherein the penalty coefficient depending on extent in which the restriction is approached, and a third calculation unit configured to calculate a evaluation value of each of said plurality of third speech unit strings by correcting the total cost with the penalty coefficient, wherein the searching unit selects the maximum W third speech unit strings from said plurality of third speech unit strings based on the evaluation value of each of said plurality of third speech unit strings.

BRIEF DESCRIPTION OF THE SEVERAL VIEWS OF THE DRAWING

FIG. 6 is a view showing an example of speech unit attribute information stored in a speech unit attribute information storage unit according to the embodiment;

FIG. 13 is a view for explaining the effect obtained by selecting a speech unit string by using a penalty coefficient according to the embodiment.

DETAILED DESCRIPTION OF THE INVENTION

An embodiment of the present invention will be described in detail below with reference to the views of the accompanying drawing.

A text-to-speech system according to an embodiment will be described first.

Figure 1:
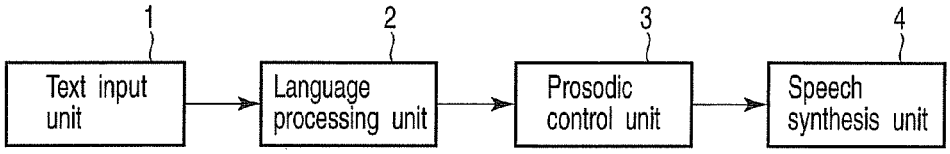
FIG. 1 is a block diagram showing an arrangement example of a text-to-speech system according to an embodiment.

FIG. 1 is a block diagram showing an arrangement example of the text-to-speech system according to the embodiment. The text-to-speech system comprises a text input unit 1, language processing unit 2, prosodic control unit 3, and speech synthesis unit 4. The language processing unit 2 performs morphological analysis/syntax analysis on the text input from the text input unit 1, and outputs the language analysis result obtained by these language analyses to the prosodic control unit 3. Upon receiving the language analysis result, the prosodic control unit 3 performs accent and intonation processes on the basis of the language analysis result to generate a phoneme string (phoneme symbol string)/prosodic information from the language analysis result, and outputs the generated phoneme string/prosodic information to the speech synthesis unit 4. Upon receiving the phoneme string/prosodic information, the speech synthesis unit 4 generates a speech wave on the basis of the phoneme string/prosodic information, and outputs the generated speech wave.

The arrangement and operation of the speech synthesis unit 4 will be mainly described in detail below.

Figure 2:
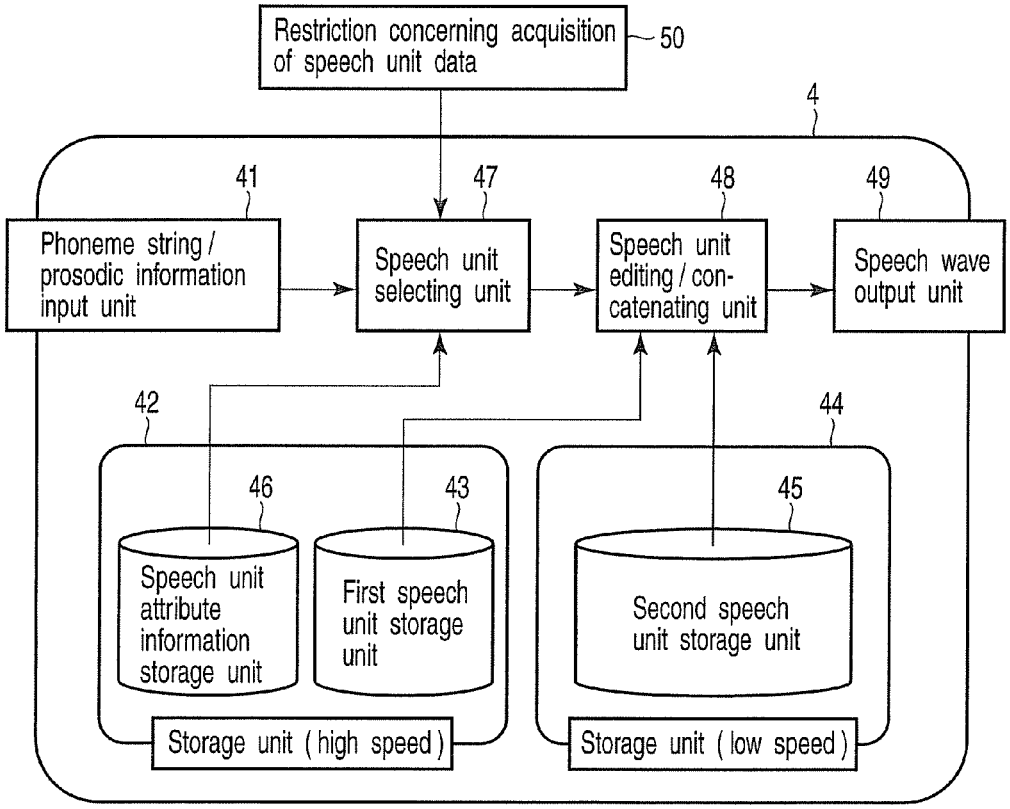
FIG. 2 is a block diagram showing an arrangement example of a speech synthesis unit according to the embodiment.

FIG. 2 is a block diagram showing an arrangement example of the speech synthesis unit 4 in FIG. 1.

Referring to FIG. 2, the speech synthesis unit 4 includes a phoneme string/prosodic information input unit 41, first speech unit storage unit 43, second speech unit storage unit 45, speech unit attribute information storage unit 46, speech unit selecting unit 47, speech unit editing/concatenating unit 48, and speech wave output unit 49.

The speech synthesis unit 4 includes a storage medium (to be referred to as a high-speed storage medium hereinafter) 42 with a high access speed (or a high data acquisition speed) and a storage medium (to be referred to as a low-speed storage medium hereinafter) 44 with a low access speed (or a low data acquisition speed).

As shown in FIG. 2, the first speech unit storage unit 43 and the speech unit attribute information storage unit 46 are placed in the high-speed storage medium 42. Referring to FIG. 2, both the first speech unit storage unit 43 and the speech unit attribute information storage unit 46 are stored in the same high-speed storage medium. Alternatively, they can be placed in different high-speed storage media. In addition, referring to FIG. 2, the first speech unit storage unit 43 is stored in one high-speed storage medium. However, the first speech unit storage unit 43 can be placed over a plurality of high-speed storage media.

As shown in FIG. 2, the second speech unit storage unit 45 is placed in the low-speed storage medium 44. Referring to FIG. 2, the second speech unit storage unit 45 is stored in one low-speed storage medium. However, the second speech unit storage unit 45 can be placed over a plurality of low-speed storage media.

In this embodiment, a high-speed storage medium will be described as a memory which allows relatively high speed access, e.g., an internal memory or a ROM, and a low-speed storage medium will be described as a memory which requires a relatively long access time, e.g., a hard disk (HDD) or a NAND flash. However, the embodiment is not limited to these combinations, and can use any combination as long as a storage medium storing the first speech unit storage unit 43 and a storage medium storing the second speech unit storage unit 45 comprise a plurality of storage media having long and short data acquisition times unique to the respective storage media.

The following exemplifies case in which the speech synthesis unit 4 comprises one high-speed storage medium 42 and one low-speed storage medium 44, the first speech unit storage unit 43 and the speech unit attribute information storage unit 46 are placed in the high-speed storage medium 42, and the second speech unit storage unit 45 is placed in the low-speed storage medium 44.

The phoneme string/prosodic information input unit 41 receives phoneme string/prosodic information from the prosodic control unit 3.

The first speech unit storage unit 43 stores some of a large quantity of speech units, and the second speech unit storage unit 45 stores the remainder of the large quantity of speech units.

The speech unit attribute information storage unit 46 stores phonetic/prosodic environments for the respective speech units stored in the first speech unit storage unit 43 and the second speech unit storage unit 45, storage information about the speech units, and the like. The storage information is information indicating in which storage medium (or in which speech unit storage unit) speech unit data corresponding to each speech unit is stored.

The speech unit selecting unit 47 selects a speech unit string from the speech units stored in the first speech unit storage unit 43 and second speech unit storage unit 45.

The speech unit editing/concatenating unit 48 generates the wave of synthetic speech by deforming and concatenating the speech units selected by the speech unit selecting unit 47.

The speech wave output unit 49 outputs the speech wave generated by the speech unit editing/concatenating unit 48.

This embodiment allows to externally designate a "restriction concerning acquisition of speech unit data" ("50" in FIG. 2) to the speech unit selecting unit 47. In order to generate synthetic speech, the speech unit editing/concatenating unit 48 needs to acquire speech unit data from the first speech unit storage unit 43 and the second speech unit storage unit 45. The "restriction concerning acquisition of speech unit data" (to be abbreviated to the data acquisition restriction hereinafter) is a restriction to be met when the speech unit editing/concatenating unit 48 performs the above acquisition (for example, a restriction concerning a data acquisition speed or a data acquisition time).

Figure 3:
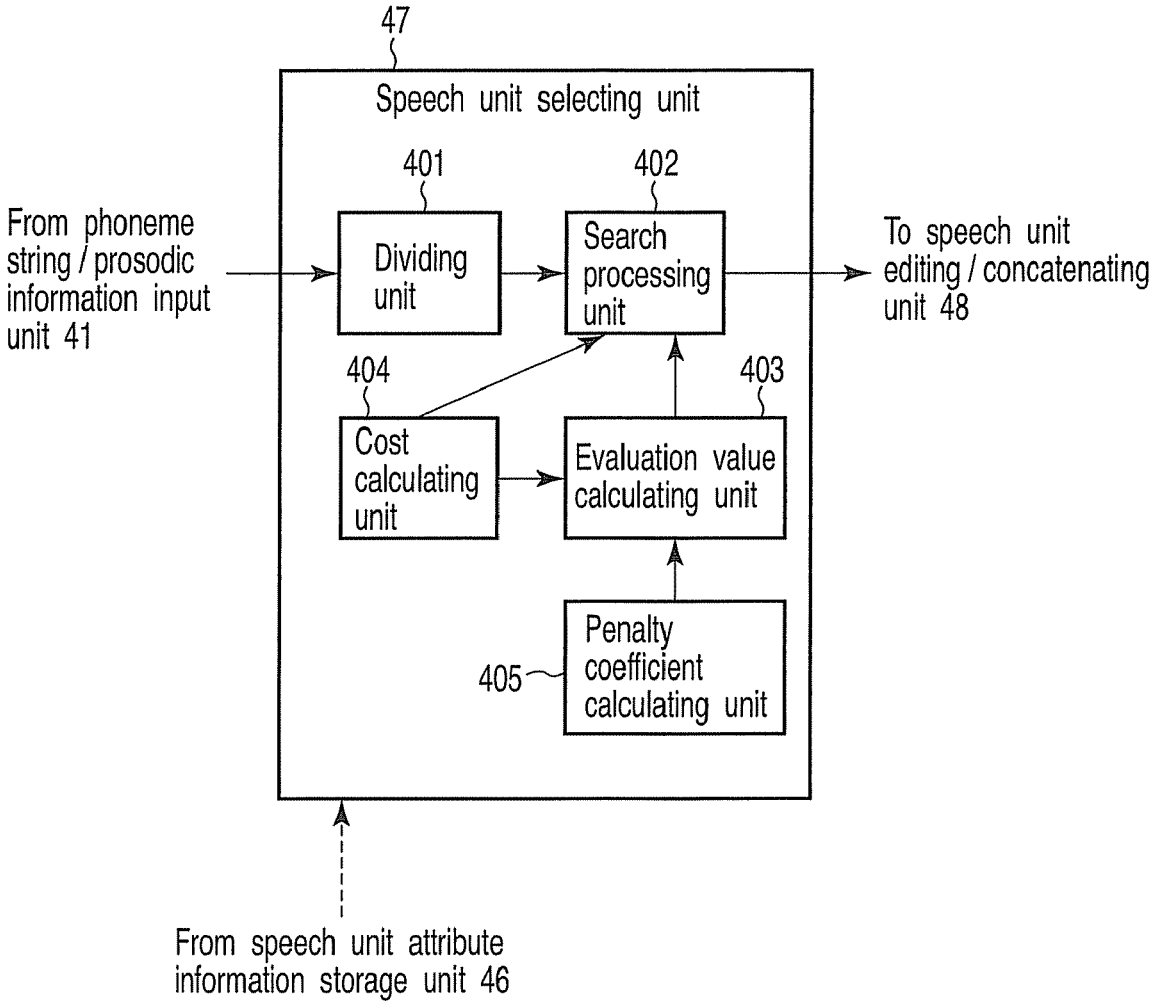
FIG. 3 is a block diagram showing an arrangement example of a speech unit selecting unit of the speech synthesis unit.

FIG. 3 shows an arrangement example of the speech unit selecting unit 47 of the speech synthesis unit 4 in FIG. 2.

As shown in FIG. 3, the speech unit selecting unit 47 includes a dividing unit 401, search processing unit 402, evaluation value calculating unit 403, cost calculating unit 404, and penalty coefficient calculating unit 405.

Each block in FIG. 2 will be described in detail next.

The phoneme string/prosodic information input unit 41 outputs, to the speech unit selecting unit 47, the phoneme string/prosodic information input from the prosodic control unit 3. A phoneme string is, for example, a phoneme symbol string. Prosodic information includes, for example, a fundamental frequency, duration, power, and the like. The phoneme string and prosodic information input to the phoneme string/prosodic information input unit 41 will be respectively referred to as an input phoneme string and input prosodic information.

Large quantities of speech units are stored in advance in the first speech unit storage unit 43 and the second speech unit storage unit 45, as units of speech (synthesis units) used upon generation synthetic speech. Each synthesis unit is a combination of phonemes or segments obtained by dividing phonemes (e.g., semiphones, monophones (C, V), diphones (CV, VC, VV), triphones (CVC, VCV), syllables (CV, V), and the like (V=vowel, C=consonant), and may have a variable length (e.g., when they are mixed)). Each speech unit represents a wave of a speech signal corresponding to a synthesis unit, a parameter sequence which represents the feature of that wave, or the like.

Figure 4:
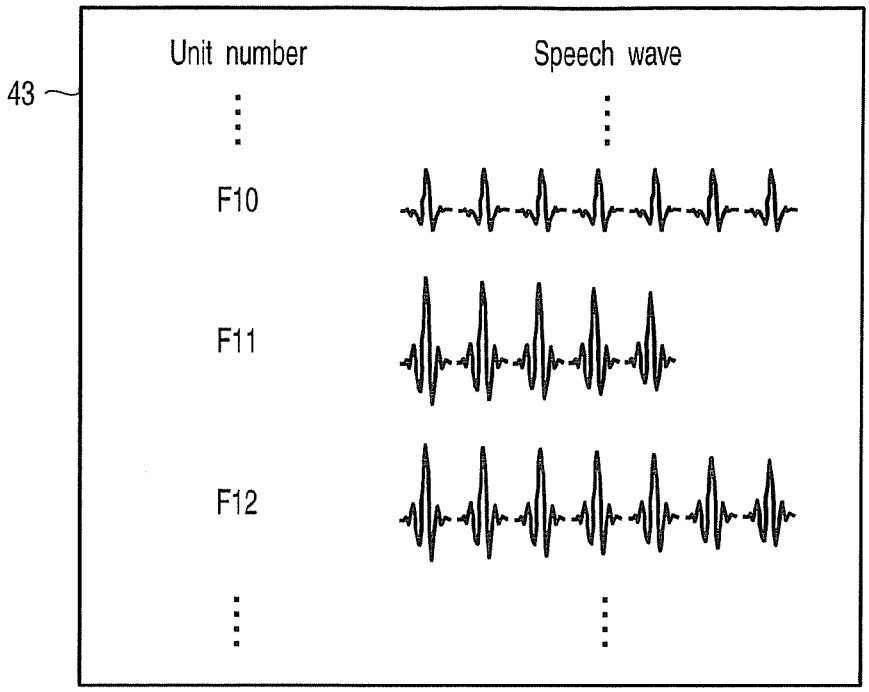
FIG. 4 is a view showing an example of speech units stored in a first speech unit storage unit according to the embodiment.
Figure 5:
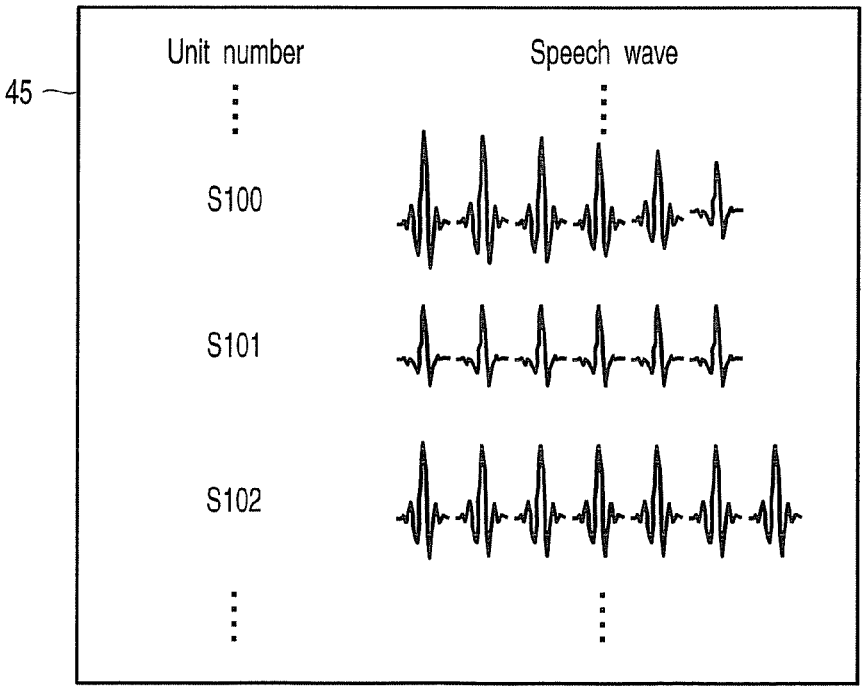
FIG. 5 is a view showing an example of speech units stored in a second speech unit storage unit according to the embodiment.

FIGS. 4 and 5 respectively show an example of speech units stored in the first speech unit storage unit 43 and an example of speech units stored in the second speech unit storage unit 45.

Referring to FIGS. 4 and 5, the first speech unit storage unit 43 and the second speech unit storage unit 45 store speech units as the waveform data of speech signals of the respective phonemes, together with unit numbers for identifying the speech units. These speech units are obtained by assigning labels to many speech data, which have been separately recorded, on a phoneme basis and extracting a speech wave for each phoneme in accordance with the label.

In this embodiment, in addition, as a speech unit of voiced speech, a pitch wave sequence obtained by decomposing an extracted speech wave into pitch wave units is held. A pitch wave is a relatively short wave which is several times as long as the fundamental period of speech and has no fundamental period by itself. The spectrum of this pitch wave represents the spectrum envelope of a speech signal. As a method of extracting such a pitch wave, a method using a fundamental period synchronized window is available. Assume that the pitch waves extracted in advance from recorded speech data by this method are to be used. More specifically, marks (pitch marks) are assigned to a speech wave extracted for each phoneme at fundamental period intervals, and the speech wave is filtered, centered on the pitch mark, by a Hanning window whose window length is twice the fundamental period, thereby extracting a pitch wave.

The speech unit attribute information storage unit 46 stores phonetic/prosodic environments corresponding to the respective speech units stored in the first speech unit storage unit 43 and second speech unit storage unit 45. A phonetic/prosodic environment is a combination of factors constituting an environment for a corresponding speech unit. The factors include, for example, the phoneme name, preceding phoneme, succeeding phoneme, second succeeding phoneme, fundamental frequency, duration, power, presence/absence of a stress, position from an accent nucleus, time from breath pause, utterance speed, emotion, and the like of the speech unit of interest. The speech unit attribute information storage unit 46 also stores data, of the acoustic features of speech units, which are used to select speech units, e.g., cepstral coefficients at the starts and ends of speech units. The speech unit attribute information storage unit 46 further stores information indicating which one of the high-speed storage medium 42 and the low-speed storage medium 44 stores the data of each speech unit.

The phonetic/prosodic environment, acoustic feature amount, and storage information of each speech unit which are stored in the speech unit attribute information storage unit 46 will be generically referred to as speech unit attribute information.

FIG. 6 shows an example of speech unit attribute information stored in the speech unit attribute information storage unit 46. In the speech unit attribute information storage unit 46 in FIG. 6, various types of speech unit attributes are stored in correspondence with the unit numbers of the respective speech units stored in the first speech unit storage unit 43 and second speech unit storage unit 45. In the example shown in FIG. 6, information stored as a phonetic/prosodic environment includes a phoneme (phoneme name) corresponding to a speech unit, adjacent phonemes (two preceding phonemes and two succeeding phonemes of the phoneme of interest in this example), a fundamental frequency, and duration. As acoustic feature amounts, cepstral coefficients at the start and end of the speech unit are stored. Storage information represents which one of the high-speed storage medium (F in FIG. 6) and the low-speed storage medium (S in FIG. 6) stores the data of each speech unit.

Note that these speech unit attributes are extracted by analyzing speech data based on which speech units are extracted. FIG. 6 shows a case in which a synthesis unit for speech units is a phoneme. However, a synthesis unit may be a semiphone, diphone, triphone, syllable, or their combination, which may have a variable length.

The operation of the speech synthesis unit 4 in FIGS. 2 and 3 will be described in detail next.

The dividing unit 401 of the speech unit selecting unit 47 divides the input phoneme string input to the speech unit selecting unit 47 via the phoneme string/prosodic information input unit 41 into synthesis units. Each of the divided synthesis units will be referred to as a segment.

The search processing unit 402 of the speech unit selecting unit 47 refers to the speech unit attribute information storage unit 46 on the basis of an input phoneme string and input prosodic information, and selects a speech unit (or the ID of a speech unit) for each segment of the phoneme string. In this case, the search processing unit 402 selects a combination of speech units under an externally designated data acquisition restriction so as to minimize the distortion between the synthetic speech obtained by using selected speech units and target speech.

The following exemplifies a case in which the upper limit value of the number of times of acquisition of speech unit data from the second speech unit storage unit 45 placed in the low-speed storage medium is used as a data acquisition restriction.

In this case, as a selection criterion for speech units, a cost is used as in the case of the general speech unit selection type speech synthesis method. This cost represents the degree of distortion of synthetic speech relative to target speech. A cost is calculated on the basis of a cost function. As a cost function, information indirectly and properly representing the distortion between synthetic speech and target speech is defined.

The details of costs and cost functions will be described first.

The costs are classified into two types of costs, i.e., a target cost and a concatenation cost. A target cost is generated when a speech unit as a cost calculation target (target speech unit) is used in a target phonetic/prosodic environment. A concatenation cost is generated when a target target speech unit is concatenated with an adjacent speech unit.

A target cost and concatenation cost respectively include sub-costs for each factor for distortion. For each sub-cost corresponding to each factor, a sub-cost function $C_n(u_i, u_{i-1}, t_i)$ (n=1, . . . , N, where N is the number of sub-costs) is defined. In this case, $t_i$ represents a phonetic/prosodic environment corresponding to the ith segment when a target phonetic/prosodic environment is represented by $t=(t_i, \ldots, t_I)$ (I: the number of segments), and $u_i$ represents a speech unit of a phoneme corresponding to ith segment.

The sub-costs of a target cost include a fundamental frequency cost representing the distortion caused by the difference between the fundamental frequency of a speech unit and a target fundamental frequency, a duration cost representing the distortion caused by the difference between the duration of the speech unit and a target duration, and a phonetic environment cost representing the distortion caused by the difference between a phonetic environment to which the speech unit belongs and a target phonetic environment.

The following is a specific example of a calculation method for each cost.

First of all, a fundamental frequency cost can be calculated by $$C_1(u_i,u_{i-1},t_i)=\{\log(f(v_i))-\log(f(t_i))\}^2 \quad (1)$$

where $v_i$ represents a phonetic environment for a speech unit $u_i$, and f represents a function for extracting an average fundamental frequency from the phonetic environment $v_i$.

A duration cost can be calculated by $$C_2(u_i,u_{i-1},t_i)=\{g(v_i)-g(t_i)\}^2 \quad (2)$$

where g represents a function for extracting a duration from the phonetic environment $v_i$.

A phonetic environment cost can be calculated by $$C_3(u_i,u_{i-1},t_i)=\Sigma r_j \cdot d(p(v_i,j)-p(t_i,j)) \quad (3)$$

In this case, the range of j in which Σ takes the total sum of $r_j \cdot d(p(v_i, j)-p(t_i, j))$ is j=−2 to 2 (j is an integer), j represents the position of a phoneme relative to a target phoneme, p represents a function for extracting phonemes adjacent to the relative position j from the phonetic environment $v_i$, d represents a function for calculating the distance between two phonemes (the difference in feature between phonemes), and $r_j$ represents the weight of an inter-phoneme distance with respect to the relative position j. In addition, d returns a value from "0" to "1". For example, d returns "0" between phonemes with the same feature, and "1" between phonemes with different feature.

The sub-costs of a concatenation cost include, for example, a spectrum concatenation cost representing the difference in spectrum at a speech unit boundary.

A spectrum concatenation cost can be calculated by $$C_4(u_i,u_{i-1},t_i)=\|h_{pre}(u_i)-h_{post}(u_{i-1})\| \quad (4)$$

where ||·|| represents a norm, $h_{pre}$ represents a function for extracting a cepstral coefficient at the front-side concatenation boundary of the speech unit $u_i$ as a vector, and $h_{post}$ represents a function for extracting a cepstral coefficient at the rear-side concatenation boundary of the speech unit $u_i$ as a vector.

The weighted sum of these sub-cost functions can be defined as a synthesis unit cost function by $$C_3(u_i,u_{i-1},t_i)=\Sigma w_n \cdot C_n(u_i,u_{i-1},t_i) \quad (5)$$

In this case, the range of n in which Σ takes the total sum of $w_n \cdot C_n(u_i, u_{i-1}, t_i)$ is n=1 to N (n is an integer), and $w_n$ represents a weight between sub-costs.

Equation (5) is an equation for calculating a synthesis cost which is a cost caused when a given speech unit is used as a given synthesis unit.

The cost calculating unit 404 of the speech unit selecting unit 47 calculates a synthesis unit cost according to equation (5) given above for each of a plurality of segments obtained by dividing an input phoneme string into synthesis units.

The cost calculating unit 404 of the speech unit selecting unit 47 can calculate a total cost TC, which is the sum of calculated synthesis unit costs for all segments, $$TC=\Sigma(C(u_i,u_{i-1},t_i))^p \quad (6)$$

In this case, the range of i in which Σ takes the total sum of $(C(u_i, u_{i-1}, t_i))^p$ is i=1 to I (i is an integer), and P is a constant.

For simplicity, assume that p=1. When p=1, a total cost representing the simple sum of the respective synthesis unit costs. A total cost representing the distortion of the synthetic speech, generated on the basis of the speech unit strings selected with respect to an input phoneme string, relative to target speech. Selecting speech unit strings so as to reduce the total cost makes it possible to generate synthetic speech having sound quality with little distortion relative to speech units.

Note that the value p in equation (6) can be other than 1. If the value p is set to be larger than 1, a speech unit string with a high synthesis unit cost is locally emphasized. This makes it difficult to select a speech unit string locally having a high synthesis unit cost.

Specific operation of the speech unit selecting unit 47 will be described next.

Figure 7:
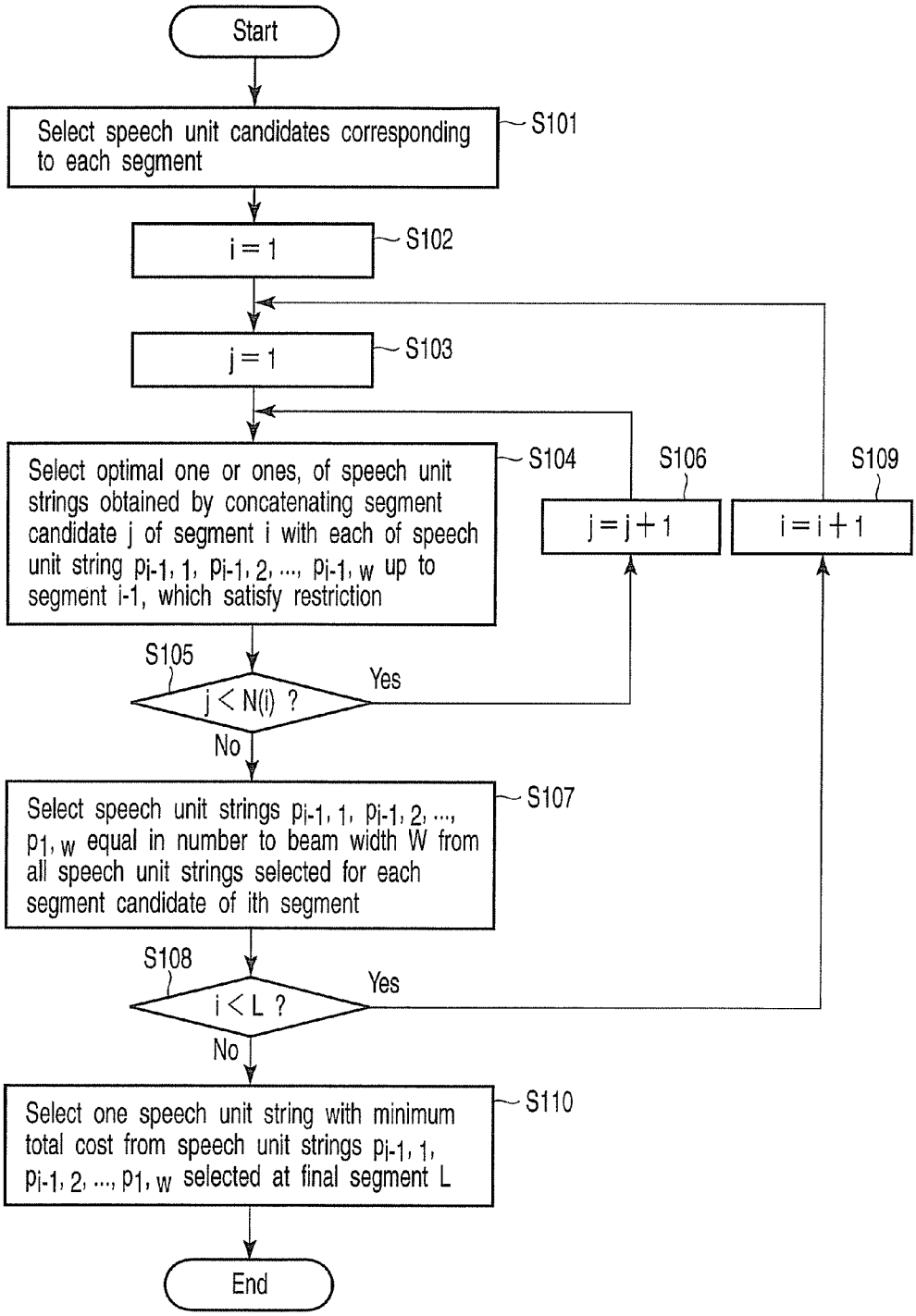
FIG. 7 is a flowchart showing an example of a selection procedure for speech units according to the embodiment.

FIG. 7 is a flowchart showing an example of a procedure by which the search processing unit 402 of the speech unit selecting unit 47 selects an optimal speech unit string. An optimal speech unit string is a combination of speech units which minimizes the total cost under an externally designated data acquisition restriction.

As indicated by equation (6) given above, since a total cost can be recursively calculated, it is possible to efficiently search for an optimal speech unit string by using the dynamic programming method.

First of all, the speech unit selecting unit 47 selects a plurality of speech unit candidates for each segment of an input phoneme string from the speech units listed in the speech unit attribute information storage unit 46 (step S101). In this case, for each segment, all speech units corresponding to the phoneme can be selected. However, the calculation amount in the following processing is reduced in the following manner. That is, only the target cost of each speech unit corresponding to the phoneme of each segment, among the above costs, is calculated by using an input target phonetic/prosodic environment. Only upper C speech units are sequentially selected for each segment in the increasing order of the calculated target costs, and the selected C speech units are set as speech unit candidates for the segment. Such processing is generally called preliminary selection.

Figure 8:
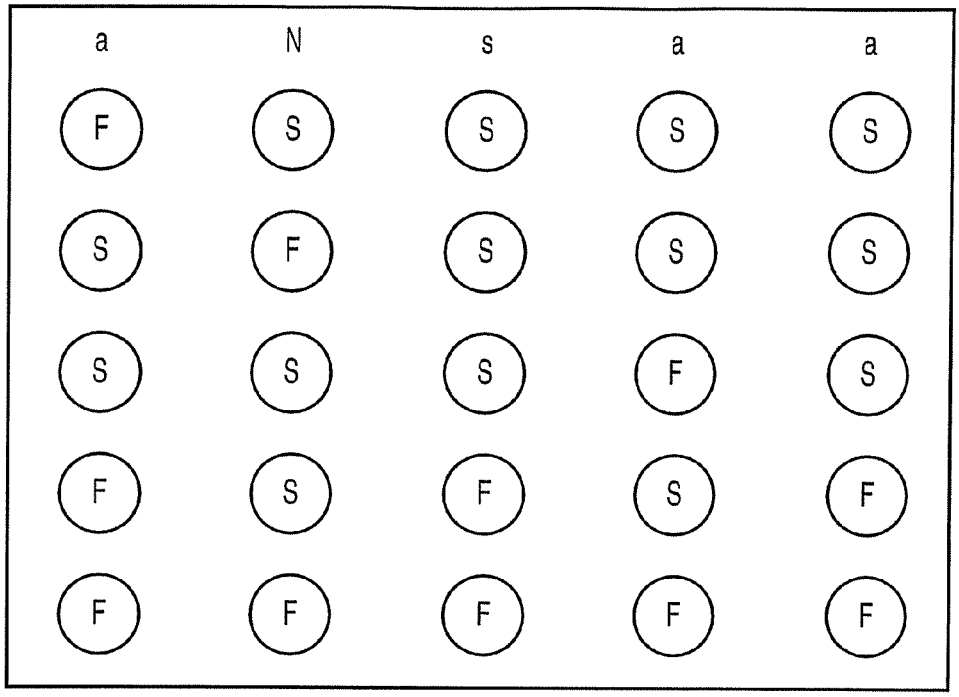
FIG. 8 is a view showing an example of speech unit candidates which are preliminarily selected.

Referring to FIG. 8, "aNsaa" represents "answer" in Japanese. An input phoneme string corresponding to the text "aNsaa" comprises "a", "N", "s", "a", and "a". FIG. 8 shows an example of selecting five speech units for each element of the input phoneme string ""a", "N", "s", "a", "a"" in preliminary selection in step S101 in FIG. 7. In this case, the white circles arrayed below each segment (each of the phonemes "a", "N", "s", "a", and "a" in this example) represent speech unit candidates corresponding to each segment. In addition, the symbols F and S in the white circles each represent the storage information of each speech unit data. More specifically, F represents that the speech unit data is stored in the high-speed storage medium, and S represents that the speech unit data is stored in the low-speed storage medium.

If only speech unit candidates whose speech unit data are stored in the low-speed storage medium are selected in preliminary selection in step S101, an externally designated data acquisition restriction may not be satisfied. For this reason, when a data acquisition restriction is externally designated, it is necessary to select at least one of speech unit candidates for each segment from speech units whose speech unit data are stored in the high-speed storage medium.

Assume that in this case, the lowest proportion of speech unit candidates, of the speech unit candidates selected for one segment, whose speech unit data are stored in the high-speed storage medium is determined in accordance with a data acquisition restriction. Assume that L represents the number of segments in an input phoneme string, and the data acquisition restriction is "the restriction that the upper limit value of the number of times of acquisition of speech unit data from the second speech unit storage unit 45 placed in the low-speed storage medium is M (M<L)". In this case, the lowest proportion is (L−M)/2L. FIG. 8 shows a case in which L=5 and M=2. Referring to FIG. 8, for each segment, two or more speech unit candidates whose speech unit data are stored in the high-speed storage medium are selected. Note that the above value "(L−M)/2L" is an example, and the above lowest proportion is not limited to this.

The speech unit selecting unit 47 sets 1 in a counter i (step S102), and sets 1 in a counter j (step S103). The process then advances to step S104.

Note that i represents unit numbers, which are 1, 2, 3, 4, and 5 sequentially assigned from the left in the case of FIG. 8, and j represents speech unit candidate numbers, which are 1, 2, 3, 4, and 5 sequentially assigned from the above in the case of FIG. 8.

In step S104, the speech unit selecting unit 47 selects one or a plurality of optimal speech unit strings, of the speech unit strings up to the jth speech unit candidate $u_{i,j}$ of the segment i, which satisfy the data acquisition restriction. More specifically, the speech unit selecting unit 47 selects one or a plurality of speech unit strings from the speech unit strings generated by concatenating the speech unit candidate $u_{i,j}$ with each of speech unit strings $p_{i-1,1}, p_{i-1,2}, \ldots, p_{i-1,w}$ (where W is the beam width) selected as speech unit strings up to an immediately preceding segment i−1.

Figure 9:
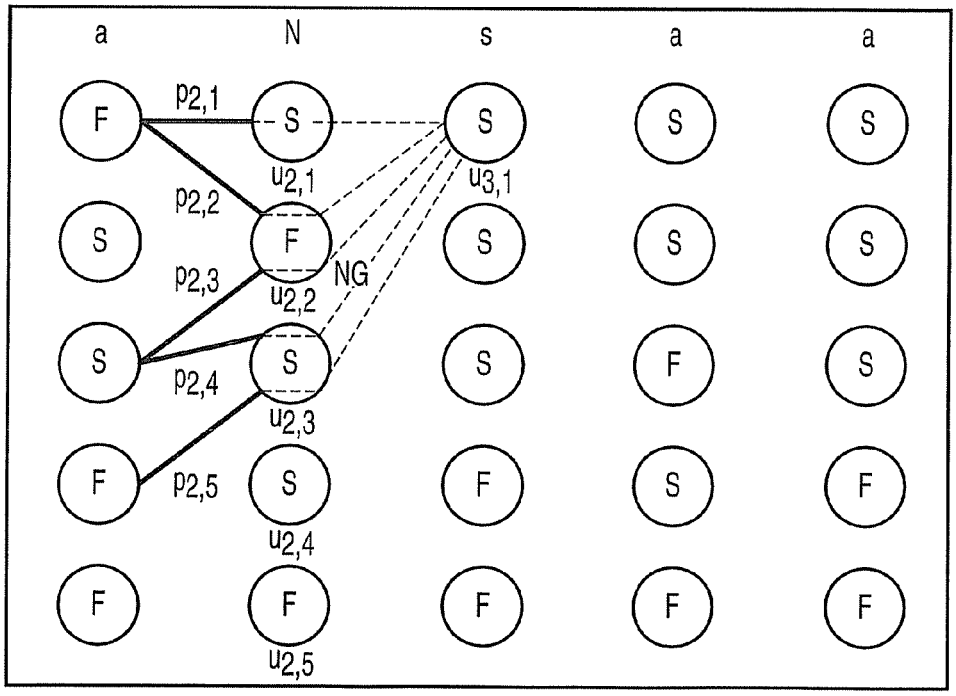
FIG. 9 is a view for explaining an example of a procedure for selecting a speech unit string for each speech unit candidate of a segment i.

FIG. 9 shows a case with i=3, j=1, and W=5. The solid lines in FIG. 9 indicate five speech unit strings $p_{2,1}, p_{2,2}, \ldots, p_{2,5}$ selected up to an immediately preceding segment (i=2), and the dotted lines indicate a state in which five new speech unit strings are generated by concatenating a speech unit candidate $u_{i,j}$ with each of these speech unit strings.

In step S104, the speech unit selecting unit 47 checks first whether the newly generated speech unit strings satisfy the data acquisition restriction. If there is any speech unit string which does not satisfy the data acquisition restriction, the speech unit string is removed. In the case of FIG. 9, the new speech unit string ("NG" in FIG. 9) extending from the speech unit string $p_{2,4}$ to a speech unit candidate $u_{3,1}$ includes three speech units whose speech unit data are stored in the low-speed storage medium. This number exceeds the upper limit value M (=2), this speech unit string is removed.

The speech unit selecting unit 47 then causes the cost calculating unit 404 to calculate the total cost of each of speech unit string candidates, of the above new speech unit strings, which are left without being removed. The speech unit selecting unit 47 selects a speech unit string with a small total cost.

A total cost can be calculated as follows. For example, the total cost of the speech unit string extending from the speech unit string $p_{2,2}$ to the speech unit candidate $u_{3,1}$ can be calculated by adding the total cost of the speech unit string $p_{2,2}$, the concatenation cost between the speech unit candidate $u_{2,2}$ and the speech unit candidate $u_{3,1}$, and the target cost of the speech unit candidate $u_{3,1}$.

The number of speech unit strings to be selected can be one, i.e., an optical speech unit string, per speech unit candidate (that is, one type of optimal speech unit string is selected), if there is no data acquisition restriction. If a data acquisition restriction is designated, an optimal speech unit string is selected for each of different "numbers of speech units which are included in the speech unit strings and whose speech unit data are stored in the low-speed storage medium" (that is, in this case, a plurality of types of optimal speech unit strings are sometimes selected). For example, in the case of FIG. 9, an optimal one of speech unit strings including two Ss and an optimal one of speech unit strings including one S are selected from the speech unit strings extending to the speech unit candidates $u_{3,1}$ (a total of two speech unit strings are selected in this case). This prevents the possibility of selection of a speech unit string extending via a given speech unit candidate from being completely eliminated by the removal of speech unit candidates under the above data acquisition restriction.

It is, however, not worth saving a speech unit string which is included in such speech unit strings and whose speech unit data stored in the low-speed storage medium are larger in number than speech unit data included in an optimal sequence extending to the speech unit candidate (whose total cost is minimum among all the speech unit strings). Such a speech unit string is therefore removed.

In addition, even different numbers of speech units whose speech unit data are stored in the low-speed storage medium are handled as the same number when the restriction on the extension to subsequent speech units remains unchanged. Assume that L=5 and M=2. In this case, if i=4, both speech unit strings whose numbers of speech units stored in the low-speed storage medium are 0 and 1, respectively, are free from the influence of the restriction. Therefore, a speech unit string including no S and a speech unit including only one S are not discriminated from each other in terms of the number of Ss.

Subsequently, the speech unit selecting unit 47 determines whether the value of the counter j is less than a number N(i) of speech unit candidates selected for the segment i (step S105). If the value of the counter j is less than N(j) (YES in step S105), the value of the counter j is incremented by one (step S106). The process returns to step S104. If the value of the counter j is equal to or more than N(j) (NO in step S105), the process advances to step S107.

In step S107, the speech unit selecting unit 47 selects W speech unit strings corresponding to a beam width W from all the speech unit strings selected for each speech unit candidate of the segment i. This processing is performed to greatly reduce the calculation amount in a search for strings by limiting the range of strings subjected to hypothesis extension at the next segment according to a beam width. Such processing is generally called a beam search. The details of this processing will be described later.

The speech unit selecting unit 47 then determines whether the value of the counter i is less than the total number L of segments corresponding to the input phoneme string (step S108). If the value of the counter i is less than L (YES in step S108), the value of the counter i is incremented by one (step S109). The process returns to step S103. If the value of the counter i is equal to or more L (NO in step S108), the process advances to step S110.

The speech unit selecting unit 47 terminates the processing upon selecting one of all the speech unit strings selected as speech unit strings extending to a final segment L which exhibits the minimum total cost.

The details of the processing in step S107 in FIG. 7 will be described next.

A general beam search is performed to select strings in number corresponding to a beam width in the decreasing order of the evaluation values of searched strings (total costs in this embodiment). If, however, there is a data acquisition restriction as in this embodiment, the following problem arises when speech unit strings in number corresponding to a beam width are simply selected in the decreasing order of total costs. The processing in steps S102 to S109 in FIG. 7 is the processing of extending the hypothesis of speech unit strings from the leftmost segment to the rightmost segment while reserving speech unit strings corresponding to a beam width which are likely to finally become optimal speech unit strings. Assume that in this processing, when processing for the segments of the first half is complete, speech unit strings including only speech units whose speech unit data are stored in the low-speed storage medium are left in the beam. In this case, in processing for the segments in the second half, only speech units whose speech unit data are stored in the high-speed storage medium can be selected. This problem is especially noticeable when the proportion of speech units whose speech unit data are stored in the high-speed storage medium is low. This is because, as a speech unit string includes more speech units with small variations whose speech unit data are stored in the high-speed storage medium, the total cost increases. When such a problem arises, the sound quality of generated synthetic speech becomes uneven, resulting in an overall deterioration in sound quality.

This embodiment therefore avoids this problem by introducing a penalty in the selection in step S107 in FIG. 7 in the following manner. Consider the proportion of speech units which are included in a speech unit string and whose speech unit data are stored in the low-speed storage medium. If the proportion of such speech units of a given speech unit string exceeds a reference set in consideration of a data acquisition restriction, a penalty is imposed on the speech unit string so as to make it difficult to select the speech unit string.

Specific operation in step S107 in FIG. 7 will be described below.

Figure 10:
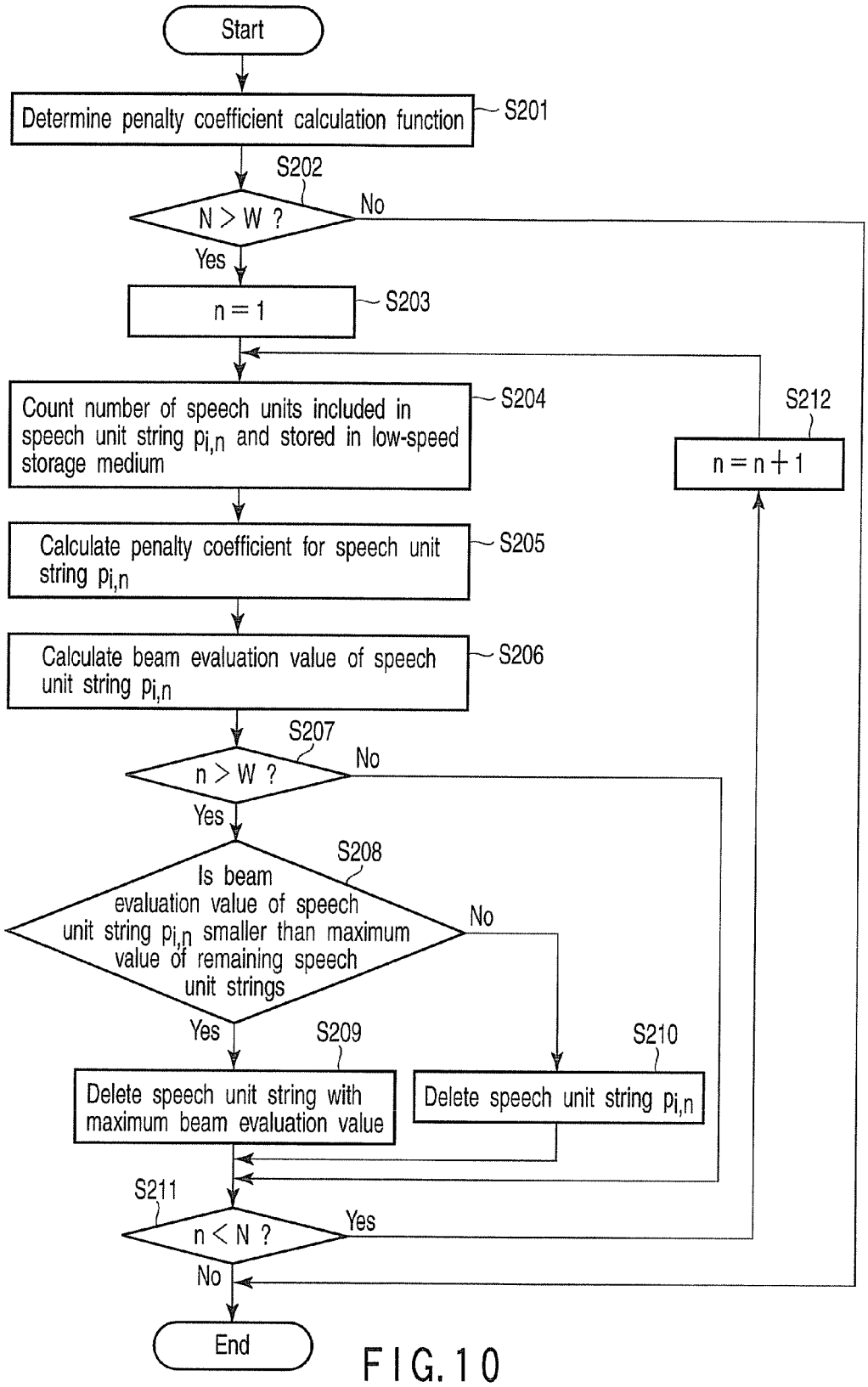
FIG. 10 is a flowchart showing an example of a selection method for a speech unit string in step S107 in FIG. 7.

FIG. 10 is a flowchart showing an example of operation in step S107 in FIG. 7.

First of all, the speech unit selecting unit 47 determines a function for calculating a penalty coefficient from a position i of a segment of interest, a total segment count L corresponding to an input phoneme string, and a data acquisition restriction (step S201). A manner of determining a penalty coefficient calculation function will be described later.

The speech unit selecting unit 47 then determines whether a total number N of speech unit strings selected for each speech unit candidate of the segment i is larger than the beam width W (step S202). If N is equal to or less than W (that is, all speech unit strings fall within the beam), all the processing is terminated (NO in step S202). If N is larger than W, the process advances to step S203 (YES in step S202) to set 1 in a counter n. The process then advances to step S204.

In step S204, with regard to an nth speech unit string $p_{i,n}$ of the speech unit strings extending to the segment i, the speech unit selecting unit 47 counts the number of speech units included in the speech unit string and whose speech unit data are stored in the low-speed storage medium. The penalty coefficient calculating unit 405 calculates a penalty coefficient corresponding to the speech unit string $p_{i,n}$ from this count by using the penalty coefficient calculation function determined in step S201 (step S205). In addition, the evaluation value calculating unit 403 calculates the beam evaluation value of the speech unit string $p_{i,n}$ from the total cost of the speech unit string $p_{i,n}$ and the penalty coefficient obtained in step S205 (step S206). In this case, a beam evaluation value is calculated by multiplying the total cost and the penalty coefficient. Note that the beam evaluation value calculation method to be used is not limited to this. It suffices to use any method as long as it can calculate a beam evaluation value from a total cost and a penalty coefficient.

The speech unit selecting unit 47 determines whether the value of the counter n is larger than the beam width W (step S207). If n is larger than W, the process advances to step S208 (YES in step S207). If n is equal to or less than W, the process advances to step S211 (NO in step S207).

In step S208, the speech unit selecting unit 47 searches speech unit strings (remaining speech unit strings), which are left without being removed at the beginning of the step S208 of interest, for a speech unit string with the maximum beam evaluation value, and determines whether the beam evaluation value of the speech unit string $p_{i,n}$ is smaller than the maximum value. If the beam evaluation value of the speech unit string $p_{i,n}$ is smaller than the maximum value (YES in step S208), the speech unit string having the maximum beam evaluation value is deleted from the remaining speech unit strings (step S209), and the process advances to step S211. If the beam evaluation value of the speech unit string $p_{i,n}$ is equal to or larger than the maximum value (NO in step S208), the speech unit string $p_{i,n}$, is deleted (step S210), and the process advances to step S211.

In step S211, the speech unit selecting unit 47 determines whether the value of the counter n is smaller than the total count N of speech unit strings selected for each speech unit candidate of the segment i. If the value of the counter n is smaller than the total count N (YES in step S211), the value of the counter n is incremented by one (step S212), and the process returns to step S204. If n is equal to or more than N (NO in step S211), the processing is terminated.

A manner of determining a penalty coefficient calculation function in step S201 will be described next.

Figure 11:
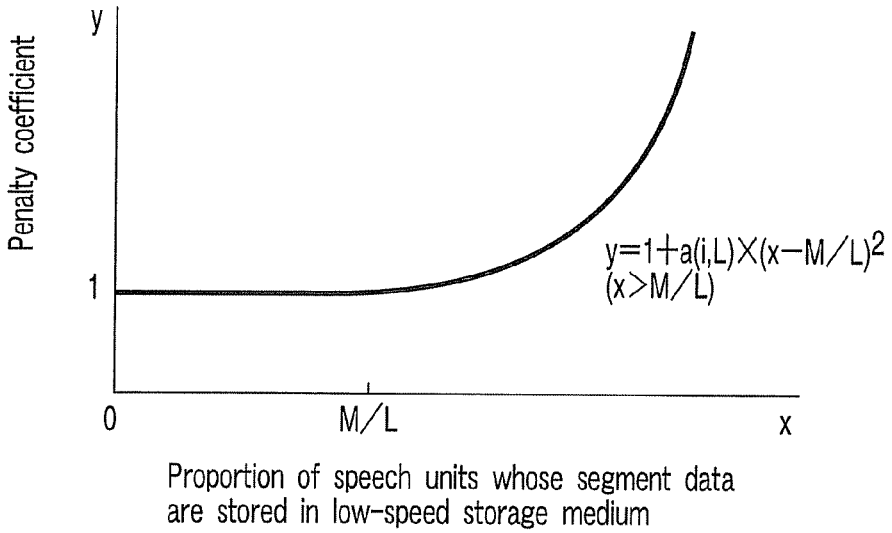
FIG. 11 is a view showing an example of a function for calculating a penalty coefficient.

FIG. 11 shows an example of a penalty coefficient calculation function. This example is a function for calculating a penalty coefficient y from a proportion x of speech units, in a speech unit string, whose speech unit data are stored in the low-speed storage medium. This function has the following characteristics. M/L represents the ratio of speech units (M) which can be acquired from the low-speed storage medium to all the segments (L) of an input phoneme string. When the proportion x falls within the range of M/L or less, the penalty coefficient y is 1 (i.e., there is no penalty). When the proportion x exceeds M/L, the penalty coefficient y monotonically increases. This makes it relatively difficult to select a speech unit string whose proportion of speech units selected from the low-speed storage medium (x) exceeds a restriction (M/L). On the other hand, this makes it relatively easy to select a speech unit string which falls within the restriction (M/L) in terms of the above proportion (x).

Another characteristic of this function is that the slope of a curve portion which monotonically increases is determined by the relationship between the position i of the segment of interest and the total segment count L. For example, the slope is determined by $\alpha(i, L)=L^2/M(L-i)$. In this case, as the number of remaining segments decreases, the slope becomes steeper. This indicates that as the number of remaining segments decreases, the degree of the influence of a restriction on the degree of freedom in selection of a speech unit string increases, and hence the effect of a penalty increases in accordance with the degree of the influence of the restriction.

Figure 12:
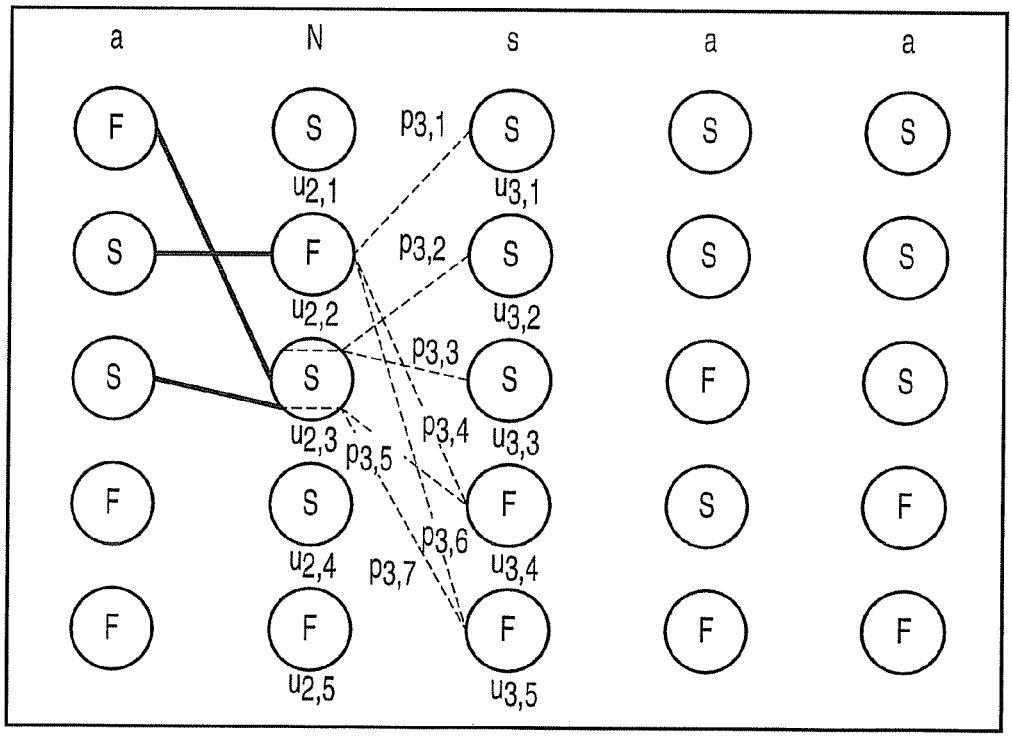
FIG. 12 is a view for explaining an example of a procedure for selecting a speech unit string by using a penalty coefficient up to the segment i.

The effect obtained by performing a beam search using the beam evaluation value calculated by using the penalty coefficient calculation function determined in the above manner will be conceptually described with reference to FIGS. 12 and 13.

Consider a case in which the segment count L is 5, the beam width W is 3, and the upper limit value M of the number of times of acquisition of speech unit data stored in the low-speed storage medium is 2. FIG. 12 shows a state immediately before the processing (step S107 in FIG. 7) of selecting a speech unit string corresponding to the beam width for the third segment ("s" in FIG. 12) after the selection of optimal speech unit strings ($p_{3,1}$ to $p_{3,7}$ in FIG. 12) corresponding to the respective speech unit candidates ($u_{3,1}$ to $u_{3,5}$ in FIG. 12) for the third segment. The solid lines in FIG. 12 indicate remaining speech unit strings selected up to the second segment "N", and the dotted lines indicate the speech unit strings selected for each speech unit candidate of the third segment "s". FIG. 13 shows the number of speech units, in each of the speech unit strings selected for the respective speech unit candidates of the third segment "s", whose speech unit data are stored in the low-speed storage medium (the number of speech unit data in the low-speed storage medium), the total cost of each speech unit string, a penalty coefficient for each speech unit string, and a beam evaluation value for each speech unit string. In addition, referring to FIG. 13, each of these speech unit strings which is selected by the conventional method of selecting speech unit strings corresponding to a beam width by using total costs is indicated by a circle, and each speech unit string selected by the method of this embodiment which selects speech unit strings corresponding to a beam width by using beam evaluation values is indicated by a circle. In this case, selection using total costs will select only speech unit strings whose numbers of speech units stored in the low-speed storage medium have reached the upper limit. This allows to select only speech unit candidates stored in the high-speed storage medium (F) for the subsequent segments. As a result, the final sound quality may greatly deteriorate. On the other hand, using beam evaluation values will also select speech unit strings whose numbers of speech units stored in the low-speed storage medium are smaller than the upper limit although which are slightly inferior in total cost. This can prevent the final sound quality from greatly deteriorating, and can select speech units from the high-speed storage medium and the low-speed storage medium in a well-balanced manner.

The speech unit selecting unit 47 selects speech unit strings corresponding to an input phoneme string by using the above method, and outputs them to the speech unit editing/concatenating unit 48.

The speech unit editing/concatenating unit 48 generates the speech wave of synthetic speech by deforming and concatenating the speech units for each segment transferred from the speech unit selecting unit 47 in accordance with input prosodic information.

Figure 14:
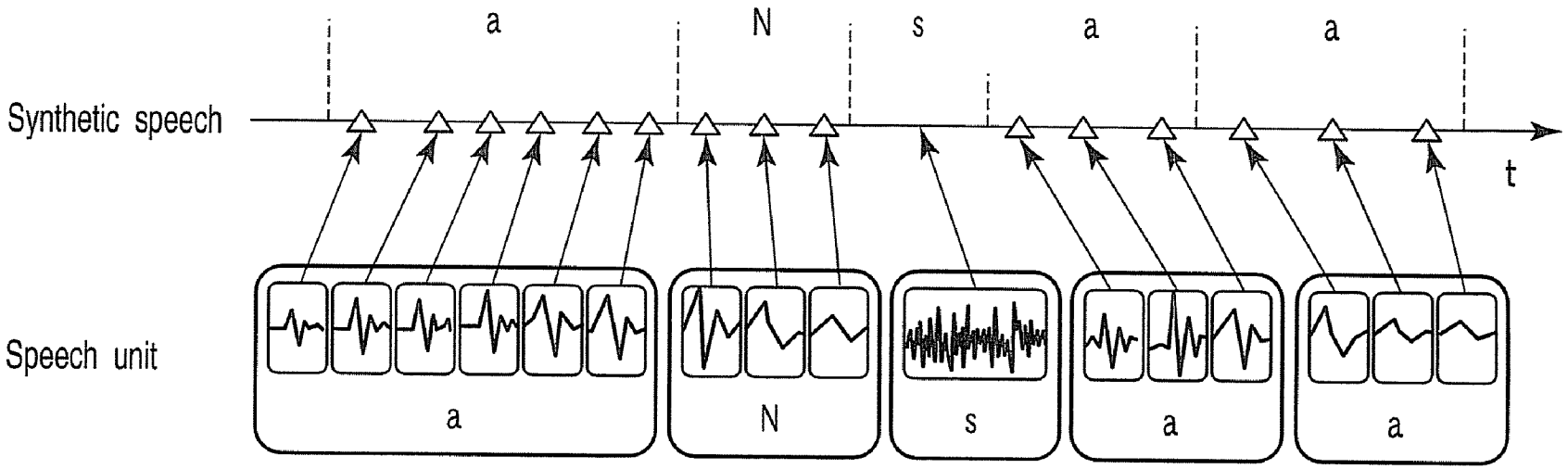
FIG. 14 is a view for explaining processing in a speech unit editing/concatenating unit according to the embodiment.

FIG. 14 is a view for explaining processing in the speech unit editing/concatenating unit 48. FIG. 14 shows a case in which the speech wave "aNsaa" is generated by deforming and concatenating the speech units corresponding to the respective synthesis units of the phonemes "a", "N", "s", "a", and "a" which are selected by the speech unit selecting unit 47. In this case, a speech unit of voiced speech is expressed by a pitch wave sequence. On the other hand, a speech unit of unvoiced speech is directly extracted from recorded speech data. The dotted lines in FIG. 14 represent the boundaries of the segments of the respective phonemes which are segmented according to target durations. The white triangles represent positions (pitch marks), arranged in accordance with target fundamental frequencies, where the respective pitch waves are superimposed. As shown in FIG. 14, for voiced speech, the respective pitch waves of a speech unit are superimposed on the corresponding pitch marks. For unvoiced speech, the wave of a speech unit expanded/contracted in accordance with the length of the segment is superimposed on the segment, thereby generating a speech wave having desired prosodic features (a fundamental frequency and duration in this case).

As described above, according to this embodiment, speech unit strings can be quickly and properly selected for a synthesis unit string under a restriction concerning the acquisition of speech unit data from the respective storage media with different data acquisition speeds.

According to the above description, the data acquisition restriction is the upper limit value of the number of times of acquisition of speech unit data from the speech unit storage unit placed in the low-speed storage medium. However, this data acquisition restriction can be the upper limit value of the time required to acquire all speech unit data in speech unit strings (including those from both the high-speed and low-speed storage media).

In this case, the speech unit selecting unit 47 predicts the time required to acquire speech unit data in a speech unit string and selects a speech unit string such that the predictive value does not exceed an upper limit value. In this case, it is possible to predict the time required to acquire speech unit data by, for example, obtaining in advance the statistic of the time required to acquire data with a given size by one access from each of the high-speed and low-speed storage media and using the obtained statistic. Most simply, the maximum value of the time required to acquire all speech units by adding up the products of the maximum value of the data acquisition time per access from each storage medium and the number of speech units to be acquired from each of the high-speed and low-speed storage media, and the obtained value can be used as a predictive value.

As described above, when the data acquisition restriction is "the upper limit value of the time required to acquire all speech unit data in a speech unit string" and a speech unit string is to be selected by using a predictive value of the time required to acquire speech unit data in a speech unit string, a penalty coefficient in a beam search performed by the speech unit selecting unit 47 is calculated by using the predictive value of the time required to acquire speech unit data in a speech unit string. A penalty coefficient calculation function can be set such that a penalty coefficient takes 1 while a predictive value P of the time required to acquire speech unit data in a speech unit string up to the segment falls within the range of a given threshold or less, and monotonically increases when the predictive value P exceeds the threshold. For example, a threshold can be calculated according to $U \times i/L$ where L is the total number of segments of an input phoneme string, U is the upper limit value of the time required to acquire all speech unit data, and i is the position of the segment. A penalty coefficient calculation function to be used in this case can have, for example, the same form as that shown in FIG. 11.

Note that each of the functions described above can be implemented by being described as software and causing a computer having a proper mechanism to process the software.

In addition, this embodiment can be implemented as a program for causing a computer to execute a predetermined procedure, causing the computer to function as predetermined means, or causing the computer to implement predetermined functions. In addition, the embodiment can be implemented as a computer-readable recording medium on which the program is recorded.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A speech synthesis system comprising:

a dividing unit configured to divide a phoneme string corresponding to target speech into a plurality of segments to generate a first segment sequence;

a selecting unit configured to generate a plurality of first speech unit strings corresponding to the first segment sequence by combining a plurality of speech units based on the first segment sequence and select one speech unit string from said plurality of first speech unit strings; and a concatenation unit configured to concatenate a plurality of speech units included in the, selected speech unit string to generate synthetic speech, the selecting unit including a searching unit configured to perform repeatedly, on a computer that includes a processor, a first processing and a second processing, the first processing generating, based on maximum W, wherein W is a predetermined value, second speech unit strings corresponding to a second segment sequence as a partial sequence of the first segment sequence, a plurality of third speech unit strings corresponding to a third segment sequence as a partial sequence obtained by adding a segment to the second segment sequence, and the second processing selecting maximum W third speech unit strings from said plurality of third speech unit strings, a first calculation unit configured to calculate a total cost of each of said plurality of third speech unit strings, a second calculation unit configured to calculate a penalty coefficient corresponding to the total cost for each of said plurality of third speech unit strings based on a restriction concerning quickness of speech unit data acquisition, wherein the penalty coefficient depending on extent in which the restriction is approached, and a third calculation unit configured to calculate a evaluation value of each of said plurality of third speech unit strings by correcting the total cost with the penalty coefficient, wherein the searching unit selects the maximum W third speech unit strings from said plurality of third speech unit strings based on the evaluation value of each of said plurality of third speech unit strings.

2. The system according to claim 1, further comprising:

a first storage unit including a plurality of storage mediums with different data acquisition speeds, which store a plurality of speech units, respectively; and a second storage unit configured to store information indicating in which one of said plurality of storage mediums each of the speech units is stored, and wherein the concatenation unit is further configured to acquire the plurality of speech units from the first storage unit in accordance with the information before concatenating the plurality of speech units, and wherein the second calculation unit is configured to calculate the penalty coefficient for each of said plurality of third speech unit strings based on a restriction concerning quickness of data acquisition which is to be satisfied when the speech units included in the first speech unit string are acquired from the first storage unit by the concatenation unit and a statistic determined depending on which one of said plurality of storage mediums each of all speech units included in the third speech unit string is stored in.

3. The system according to claim 2, wherein said plurality of storage mediums include a storage medium with a high data acquisition speed and a storage medium with a low data acquisition speed, and the restriction is an upper limit value of the number of times of acquisition of speech unit data included in the first speech unit string from the storage medium with the low data acquisition speed, and the statistic is a proportion of the number of speech units stored in the storage medium with the low data acquisition speed to the number of speech units included in the third speech unit string.

4. The system according to claim 2, wherein said plurality of storage mediums include a storage medium with a high data acquisition speed and a storage medium with a low data acquisition speed, and the restriction is an upper limit value of a time required to acquire all speech unit data included in the first speech unit string from the first storage unit, and the statistic is a predictive value of a time required to acquire all speech unit data included in the third speech unit string from the first storage unit.

5. The system according to claim 2, wherein the penalty coefficient monotonically increases when the statistic exceeds a threshold determined by the restriction.

6. The system according to claim 5, wherein while the penalty coefficient monotonically increases, a slope of an increase in the penalty coefficient relative to an increase in the statistic becomes steeper as a proportion of the number of speech units included in the third speech unit string to the number of speech units included in the first speech unit string increases.

7. The system according to claim 1, wherein the third segment sequence is obtained by adding a next segment located at a position next to a portion of the first segment sequence which corresponds to the second segment sequence to the second segment sequence.

8. The system according to claim 7, wherein the third speech unit string is generated by adding a speech unit corresponding to the next segment to the second speech unit string.

9. A speech synthesis method comprising:

dividing a phoneme string corresponding to target speech into a plurality of segments to generate a first segment sequence;

generating a plurality of first speech unit strings corresponding to the first segment sequence by combining a plurality of speech units based on the first segment sequence and selecting one speech unit string from said plurality of first speech unit strings; and concatenating a plurality of speech units included in the selected speech unit string to generate synthetic speech, the generating/selecting including performing repeatedly a first processing and a second processing, the first processing generating, based on maximum W, wherein W is a predetermined value, second speech unit strings corresponding to a second segment sequence as a partial sequence of the first segment sequence, a plurality of third speech unit strings corresponding to a third segment sequence as a partial sequence obtained by adding a segment to the second segment sequence, and the second processing selecting maximum W third speech unit strings from said plurality of third speech unit strings, calculating a total cost of each of said plurality of third speech unit strings, calculating a penalty coefficient corresponding to the total cost for each of said plurality of third speech unit strings based on a restriction concerning quickness of speech unit data acquisition, wherein the penalty coefficient depending on extent in which the restriction is approached, and calculating a evaluation value of each of said plurality of third speech unit strings by correcting the total cost with the penalty coefficient, wherein the second processing including selecting the maximum W third speech unit strings from said plurality of third speech unit strings based on the evaluation value of each of said plurality of third speech unit strings.

10. The method according to claim 9, further comprising:

preparing in advance a first storage unit including a plurality of storage mediums with different data acquisition speeds, which store a plurality of speech units, respectively;

preparing in advance a second storage unit configured to store information indicating in which one of said plurality of storage mediums each of the speech units is stored; and acquiring the plurality of speech units from the first storage unit in accordance with the information before concatenating the plurality of speech units, and wherein the calculating the penalty coefficient including calculating the penalty coefficient for each of said plurality of third speech unit strings based on a restriction concerning quickness of data acquisition which is to be satisfied when the speech units included in the first speech unit string are acquired from the first storage unit by the concatenation unit and a statistic determined depending on which one of said plurality of storage mediums each of all speech units included in the third speech unit string is stored in.

11. The method according to claim 10, wherein said plurality of storage mediums include a storage medium with a high data acquisition speed and a storage medium with a low data acquisition speed, and the restriction is an upper limit value of the number of times of acquisition of speech unit data included in the first speech unit string from the storage medium with the low data acquisition speed, and the statistic is a proportion of the number of speech units stored in the storage medium with the low data acquisition speed to the number of speech units included in the third speech unit string.

12. The method according to claim 10, wherein said plurality of storage mediums include a storage medium with a high data acquisition speed and a storage medium with a low data acquisition speed, and the restriction is an upper limit value of a time required to acquire all speech unit data included in the first speech unit string from the first storage unit, and the statistic is a predictive value of a time required to acquire all speech unit data included in the third speech unit string from the first storage unit.

13. The method according to claim 10, wherein the penalty coefficient monotonically increases when the statistic exceeds a threshold determined by the restriction.

14. The method according to claim 13, wherein while the penalty coefficient monotonically increases, a slope of an increase in the penalty coefficient relative to an increase in the statistic becomes steeper as a proportion of the number of speech units included in the third speech unit string to the number of speech units included in the first speech unit string increases.

15. The method according to claim 9, wherein the third segment sequence is obtained by adding a next segment located at a position next to a portion of the first segment sequence which corresponds to the second segment sequence to the second segment sequence.

16. The method according to claim 15, wherein the third speech unit string is generated by adding a speech unit corresponding to the next segment to the second speech unit string.

17. A non-transitory computer readable storage medium storing instructions of a computer program which when executed by a computer results in performance of steps comprising:

dividing a phoneme string corresponding to target speech into a plurality of segments to generate a first segment sequence;

generating a plurality of first speech unit strings corresponding to the first segment sequence by combining a plurality of speech units based on the first segment sequence and selecting one speech unit string from said plurality of first speech unit strings; and concatenating a plurality of speech units included in the selected speech unit string to generate synthetic speech, the generating/selecting including performing repeatedly a first processing and a second processing, the first processing generating, based on maximum W, wherein W is a predetermined value, second speech unit strings corresponding to a second segment sequence as a partial sequence of the first segment sequence, a plurality of third speech unit strings corresponding to a third segment sequence as a partial sequence obtained by adding a segment to the second segment sequence, and the second processing selecting maximum W third speech unit strings from said plurality of third speech unit strings, calculating a total cost of each of said plurality of third speech unit strings, calculating a penalty coefficient corresponding to the total cost for each of said plurality of third speech unit strings based on a restriction concerning quickness of speech unit data acquisition, wherein the penalty coefficient depending on extent in which the restriction is approached, and calculating a evaluation value of each of said plurality of third speech unit strings by correcting the total cost with the penalty coefficient, wherein the second processing including selecting the maximum W third speech unit strings from said plurality of third speech unit strings based on the evaluation value of each of said plurality of third speech unit strings.

18. The computer readable storage medium according to claim 17, wherein the steps further comprising:

preparing in advance a first storage unit including a plurality of storage mediums with different data acquisition speeds, which store a plurality of speech units, respectively;

preparing in advance a second storage unit configured to store information indicating in which one of said plurality of storage mediums each of the speech units is stored; and acquiring the plurality of speech units from the first storage unit in accordance with the information before concatenating the plurality of speech units, and wherein the calculating the penalty coefficient including calculating the penalty coefficient for each of said plurality of third speech unit strings based on a restriction concerning quickness of data acquisition which is to be satisfied when the speech units included in the first speech unit string are acquired from the first storage unit by the concatenation unit and a statistic determined depending on which one of said plurality of storage mediums each of all speech units included in the third speech unit string is stored in.

19. The computer readable storage medium according to claim 18, wherein said plurality of storage mediums include a storage medium with a high data acquisition speed and a storage medium with a low data acquisition speed, and the restriction is an upper limit value of the number of times of acquisition of speech unit data included in the first speech unit string from the storage medium with the low data acquisition speed, and the statistic is a proportion of the number of speech units stored in the storage medium with the low data acquisition speed to the number of speech units included in the third speech unit string.

20. The computer readable storage medium according to claim 18, wherein said plurality of storage mediums include a storage medium with a high data acquisition speed and a storage medium with a low data acquisition speed, and the restriction is an upper limit value of a time required to acquire all speech unit data included in the first speech unit string from the first storage unit, and the statistic is a predictive value of a time required to acquire all speech unit data included in the third speech unit string from the first storage unit.

21. The computer readable storage medium according to claim 18, wherein the penalty coefficient monotonically increases when the statistic exceeds a threshold determined by the restriction.

22. The computer readable storage medium according to claim 21, wherein while the penalty coefficient monotonically increases, a slope of an increase in the penalty coefficient relative to an increase in the statistic becomes steeper as a proportion of the number of speech units included in the third speech unit string to the number of speech units included in the first speech unit string increases.

23. The computer readable storage medium according to claim 17, wherein the third segment sequence is obtained by adding a next segment located at a position next to a portion of the first segment sequence which corresponds to the second segment sequence to the second segment sequence.

24. The computer readable storage medium according to claim 23, wherein the third speech unit string is generated by adding a speech unit corresponding to the next segment to the second speech unit string.

* * * * *